US005123981A

United States Patent [19]

Mullay et al.

[11] Patent Number: 5,123,981

[45] Date of Patent: Jun. 23, 1992

[54] COATED SOLID ADDITIVES FOR EXPLOSIVES

[75] Inventors: John J. Mullay, Tamaqua; Jane M. Farkas, Palmerton, both of Pa.

[73] Assignee: Atlas Powder Company, Dallas, Tex.

[21] Appl. No.: 678,452

[22] Filed: Apr. 1, 1991

Related U.S. Application Data

[62] Division of Ser. No. 538,128, Jun. 14, 1990, Pat. No. 5,120,375.

[51] Int. Cl.[5] ..... C06B 45/34

[52] U.S. Cl. ..... 149/7; 149/6

[58] Field of Search ..... 149/6, 7

[56] References Cited

U.S. PATENT DOCUMENTS

| | | | |
|---|---|---|---|
| 3,447,978 | 6/1969 | Bluhm | 149/2 |
| 3,715,247 | 2/1973 | Wade | 149/21 |
| 3,765,964 | 10/1973 | Wade | 149/2 |
| 3,770,522 | 11/1973 | Tomic | 149/2 |
| 4,097,316 | 6/1978 | Mullay | 149/2 |
| 4,111,727 | 9/1978 | Clay | 149/2 |
| 4,141,767 | 2/1979 | Sudweeks | 149/2 |
| 4,181,546 | 1/1980 | Clay | 149/21 |
| 4,294,633 | 10/1981 | Clay | 149/2 |
| 4,357,184 | 11/1982 | Binet et al. | 149/2 |
| 4,376,113 | 3/1983 | Suglia et al. | 252/316 |
| 4,514,511 | 4/1985 | Jacques et al. | 502/8 |
| 4,534,809 | 8/1985 | Takeuchi et al. | 149/3 |
| 4,555,278 | 11/1985 | Cescoa | 149/21 |
| 4,615,751 | 10/1986 | Smith | 149/2 |
| 4,708,753 | 11/1987 | Forsberg | 149/2 |
| 4,732,627 | 3/1988 | Cooper et al. | 149/2 |
| 4,772,308 | 9/1988 | Zuriemendi et al. | 71/27 |
| 4,784,706 | 11/1988 | McKenzie | 149/2 |
| 4,808,251 | 2/1989 | Ghosh et al. | 149/2 |
| 4,820,361 | 4/1989 | McKenzie et al. | 149/2 |
| 4,822,433 | 4/1989 | Cooper et al. | 149/2 |
| 4,828,633 | 5/1989 | Forsberg | 149/2 |
| 4,919,179 | 4/1990 | Chattopadhyay | 149/2 |
| 5,034,071 | 7/1991 | Van Ommeren | 149/7 |

FOREIGN PATENT DOCUMENTS 0331430 6/1989 United Kingdom .

*Primary Examiner*—Stephen J. Lechert, Jr.
*Attorney, Agent, or Firm*—Richards, Medlock and Andrews

[57] ABSTRACT

In one aspect, the present invention relates to coating a solid which has acid or base sites on its surface with a surfactant having acid or base characteristics capable of neutralizing the acidic or basic characteristics of the solid surface. Said coating applied in sufficient quantity to result in neutralization of the acid or base sites on the solid. In another aspect, the present invention relates to a water-in-oil or melt-in-fuel blended explosive composition including solid components wherein said solid components have a coating to neutralize the acid or base sites on the solid, and the emulsifier utilized in the emulsion has acid or base properties which are the same as the properties of the coating applied to the solid.

23 Claims, No Drawings

COATED SOLID ADDITIVES FOR EXPLOSIVES

This is a divisional of application Ser. No. 07/538,128, filed Jun. 14, 1990 now U.S. Pat. No. 5,120,375.

TECHNICAL FIELD OF THE INVENTION

The invention relates to coatinqs for solid additives for water-in-oil and melt-in-fuel emulsion explosives and blasting agents. Specifically, the invention relates to coatings which make the additives more compatible with the water-in-oil or melt-in-fuel emulsions and also improves the stability of the water-in-oil or melt-in-fuel emulsion explosives.

BACKGROUND OF THE INVENTION

Water-in-oil emulsion blasting agents are known and were first disclosed in U.S. Pat. No. 3,447,978 to Bluhm. These explosives demonstrated in a three-inch diameter high velocities of detonation, typically exceeding about 17,000 feet per second. These emulsions were rendered detonable by incorporating occluded gas or voids to make the explosive sensitive to detonation by a booster charge. The density of the explosive was decreased by occluded gas or the inclusion of density-reducing agents such as closed-cell void containing materials. For example, microballoons were used.

Subsequent to the general development of water-in-oil emulsion explosives, water-in-oil emulsion explosive compositions containing solid particulate ammonium nitrate ("AN") or ammonium nitrate fuel oil ("ANFO") were developed for use in large diameter bore holes typically larger than four inches in diameter. Such compositions are illustrated in U.S. Pat. Nos. 4,555,278; 4,111,727; and 4,181,546. The addition of solid oxidizer salts generally reduces the velocity of the water-in-oil emulsion explosive but the velocity remains high enough to be useful and in particular, the lower velocity is beneficial for heaving and mining of softer rock and ore formations such as in strip mining of coal. These blended water-in-oil emulsion compositions containing solid particulate oxidizer salts, AN or ANFO, are typically mixed together at the site at which they are employed and detonated rather quickly, that is, generally within less than 24 hours.

Although dynamite explosives become less sensitive to detonation as the diameter decreases, in the mining industry they were continued to be utilized after the development of water-in-oil emulsions particularly in underground operations and in very hard rock formations. However, the industry has always been interested in the replacement of dynamite by a suitable explosive which is less hazardous to manufacture, cheaper, and yet provides the performance characteristics of dynamite. Dynamite was and still is extensively used in operations where bore hole diameters are less than 2.5 inches. In response to the need to provide a suitable substitute for dynamite, Atlas Powder Company developed Powermax. These compositions are generally disclosed in U.S. Pat. No. 4,110,134 to Wade. Wade developed small diameter, typically 1.25 inches and less, explosives which were reliably detonable by a #6 blasting cap. These compositions have, to some extent, replaced dynamite.

In addition to water-in-oil emulsions so-called melt-in-fuel or anhydrous emulsions can also be utilized. These emulsions are described in U.S. Pat. No. 4,248,644 to Healy. They are similar to water-in-oil emulsions except that they contain no water in the oxidizer or discontinuous phase of the emulsion. Further, melt-in-fuel emulsions do not contain water in the fuel phase.

Explosives are selected for use in particular applications depending upon the result desired. For example, in highway construction when cutting through mountains, it is generally desirable to use a high velocity explosive which creates a shock wave which completely fractures a rock. This will then produce a face which is relatively intact and less likely to cave in. In contrast, in other applications, it is desirable to obtain heaving and fracturing of the rock. This result is generally accomplished by a lower velocity explosive. Thus, in open pit mining it is more preferred to use a heaving explosive which pushes the ore away from the face and also pulverizes the ore. This allows the ore to be more easily removed and processed. Also, in the selection of explosives, the power possessed by volume of an explosive is important to achieve the best efficiency in the mining operations. With water-in-oil and melt-in-fuel emulsion explosive compositions, the velocity and power of explosive compositions can be affected in a positive manner by the addition of certain solid components. However, the drawback to the addition of solids to water-in-oil and melt-in-fuel emulsion explosives is that the solids tend to destabilize the emulsion. A tendency to destabilize indicates that the emulsion will break, i.e., that the discontinuous phase will not remain dispersed throughout the continuous phase. When the emulsion breaks, the explosive becomes less sensitive to detonation and, depending on the degree of breakdown, may become nondetonable. Further, generally upon breaking the emulsion becomes hard and is harder to handle, i.e., pump or auger. Stability is a very important factor in small diameter water-in-oil and melt-in-fuel emulsions intended to be replacements for dynamite, as they are generally prepackaged and thus must have a sufficient shelf-life in which they retain their desired properties.

It was generally believed that the solids caused instability of water-in-oil emulsions by causing migration of the water from the dispersed aqueous phase in the emulsion and destabilizing the droplets such that the emulsion would break. The approach taken previously to make the solids more compatible with the emulsion was to coat the solids with a waterproof coating such as waxes or film forming plastics, for example cellulose acetate butyrate. For example, see U.S. Pat. No. 4,555,271. This approach has obtained only limited success. In contrast, no explanation has been given for the destabilization of melt-in-fuel or anhydrous emulsion explosives. That is, since the anhydrous emulsion contains no water in the dispersed phase the explanation given for the breakdown of water-in-oil emulsions does not apply.

The present invention yields the technical advantage of providing coatings for solid components which increase the stability of water-in-oil and melt-in-fuel emulsion compositions into which the solids are incorporated without the use of waterproofing agents.

SUMMARY OF THE INVENTION

In one aspect, the invention relates to a coating for solid materials to be blended with water-in-oil or melt-in-fuel emulsion explosive compositions. The solids can be void containing materials to reduce density, materials to resist dead pressing such as cork, and materials to increase strength of the explosive such as metals and solid oxidizer components. These solids are characterized as either having an affinity for acids or bases. That is, the surface of these solids are either basic and attract acidic materials or acidic and attract basic materials. This acid or base affinity of the solids results in emulsion breakdown. One aspect of the invention is a coating which is effective to neutralize the acid or base sites on the surface of the solid component. Where the solid component surface is characterized by base sites, the coating employed as a surfactant should have an acid moiety in a sufficient degree to substantially neutralize the base sites on the solids. For solids which have a surface characterized by acid sites, the coating is a surfactant which has a basic moiety which is effective to substantially neutralize the acid sites on the solid surface.

In another aspect, the present invention relates to solids which are coated with a surfactant which neutralizes the acid or base surface of the solid.

In another aspect, the present invention relates to a blended explosive composition utilizing solid components in a water-in-oil or melt-in-fuel emulsion explosive wherein the composition includes solid components which have been coated with a surfactant which substantially neutralizes the acid or base surface of the solid, and a water-in-oil or melt-in-fuel emulsion with an emulsifier or a blended emulsifier having acid or base properties which are the same as the surfactant utilized to coat the solid component.

DETAILED DESCRIPTION

Solid additives have been used with both water-in-oil and melt-in-fuel emulsion explosives and blasting agents. These solids have been employed to impart various properties to the final explosive product. The solids include density-reducing material such as closed-cell void containing material, such as glass microspheres or resin microballoons, solid fuels such as aluminum and finely divided coal, etc. There has also been utilized solid oxidizer particles such as particulate ammonium nitrate, ammonium nitrate prills, and sodium nitrate in particulate and prill form. Also, various cushioning agents, such as cork, to reduce or produce precompression resistance have been used. Further, densifiers and sensitizers such as ferrophosphorous and alumina or solid high explosives such as TNT, smokeless powder, etc., have been employed. as known in the art, more than one of the above solids can be used in a particular blended emulsion.

In many cases these solids destabilize the emulsion to the point at which the final product is no longer detonable. The present invention is directed to a coating which coats these various solids such that their tendency to destabilize the emulsion is reduced or eliminated. While solids create this problem in all diameters of explosives, from small to medium to large, the present invention is particularly addressed to small diameter explosives. The problems caused by solids in water-in-oil or melt-in-fuel emulsions is particularly acute in small diameter materials because a greater overall sensitivity level is required with these materials. Small diameter explosives are understood in the industry to be explosives having a diameter of about 2 inches and less.

An acid is a chemical grouping (moiety) that is deficient in electrons, i.e., can accept electrons. An example is the hydrogen ion [$H^+$] that has no electrons associated with it. A base is a chemical grouping (moiety) that has an excess of electrons, i.e., can donate electrons. An example is an amine group [$PNH_2$] in which the nitrogen atom has an electron pair that it can donate to an acid. A solid surface can have acidic or basic active sites by having an acidic or basic moiety at the surface of the solid. For example, an acidic moiety at the surface of a solid is illustrated by the ammonium group [$NH_4^+$] from ammonium nitrate. Thus, solid ammonium nitrate typically has a surface which has active acidic sites.

In accordance with the present invention, if the solid has active acidic sites, then the surfactant coating employed in the practice of the present invention has a basic moiety sufficient to substantially neutralize the active acidic sites of the solid. Thus, where the solid particle is ammonium nitrate having active acidic sites, i.e., acidic moieties at the surface of the solid, the surfactant utilized to neutralize the surface is characterized by basic moieties. An example of such a surfactant is Lilamine AC-59L which contains an amine head group and a lipophilic tail. Lilamine® AC-59L consists of a hydrogenated tallow amine neutralized with organic acid. The neutralized amine is diluted with hydrotreated mineral oils. Lilamine®AC-59L is produced and sold by Berol Nobel, Nacka, AB of Stockholm, Sweden. Lilamine® AC-59L has a specific gravity, i.e., a density of 7.39 lb/gal at 158° F. (water=1); a melting point of 126° F.; an evaporation rate less than 1 (butyl acetate=1); a vapor density greater than 1 (air=1); is insoluble in water (soluble in ethanol); and has a flash point of over 300° F. cc.

Without a coating to neutralize the surface of the solid, it is believed that the solid in water-in-oil or melt-in-fuel explosives causes destabilization by attracting the emulsifier used to produce the water-in-oil or melt-in-fuel emulsion to the surface of the solid thereby depleting the emulsion of the emulsifier, thus causing the emulsion to break. Specifically, the solid attracts the emulsifying agents in the water-in-oil emulsion. When the solid is added to the emulsion, a competition is set up between the solid and the discontinuous aqueous phase droplet of the emulsion for the same emulsifier. This can lead to depletion of the emulsifier at the surface of the droplet thereby causing emulsion instability. In essence, the solid can cause migration of the emulsifier from the oxidizer droplet to the surface of the solid. The problem was previously approached by using an emulsifier for the emulsion that would allow the maximum stability of the emulsion, thereby increasing the time required to produce instability. The second approach was to coat the solid with a water impenetrable coating. These approaches partially alleviated the problem but did not resolve the problem satisfactorily in water-in-oil emulsions and did not even address the problem in melt-in-fuel emulsions.

In addition, to produce a stable blended composition of the final explosive, which is a water-in-oil or melt-in-fuel emulsion containing solid components, it is necessary to select the emulsifier used to form the emulsion such that it is compatible with the surfactant utilized to coat the solid and vice versa. If the solid has active acidic sites and the emulsifier has a basic moiety, then a basic moiety is required in the surfactant coating to neutralize these sites. Without such a coating, the emulsifier used to form the emulsion which has a basic moiety will be attracted to the solid. Thus, for example, in producing a blended explosive with a polyisobutylene succinic anhydride emulsifier and solid ammonium nitrate without a coating, the emulsifier which contains a basic moiety as part of its hydrophilic group will be attracted to the acid surface of the ammonium nitrate solid. Then, in this case the imposition of a surfactant having a basic moiety on the surface of the solid ammonium nitrate will be required to neutralize the active acidic sites of the solid's surface. An example of such a surfactant is one containing a long chain aliphatic amine. However, various surfactants can be used. Specifically, any compound that reduces surface tension when dissolved in water or water solution, or which reduces interfacial tension between two liquids, or between a liquid and a solid. The amount of surfactant utilized to coat the solid should be that which is necessary to neutralize or substantially neutralize the surface of the solid. The actual amount of surfactant required cannot be determined a priori. It must be determined through experimentation. This can involve either screening tests described below or optimization tests utilizing actual explosive formulations. In the event the solid has active basic sites on its surface, like some rubber materials, and the emulsifier has an acidic moiety the solid surface should be coated with a surfactant which has an acidic moiety such as oleic acid.

One type of additive which can be incorporated into a water-in-oil or melt-in-fuel emulsion explosive is a cushioning agent to increase precompression resistance of the explosive. Explosive charges are many times set out in a pattern in which the various charges are detonated in delayed sequence, causing a ripple effect. Detonation of the earliest charges can cause precompression of the later charges. Precompression reduces the sensitivity of the later charges and may render them nondetonable. Cushioning agents are utilized to minimize precompression problems. Such cushioning agents can include cork, rubber, balsa wood particles, or plastic microspheres. Experimentation has shown that cork and balsa have active acid sites. Plastic microspheres and rubber can have either active acidic or basic sites depending on the specific type.

EXAMPLE I

Tables I and II contain data on the use of a cork additive. Use of cork as a precompression additive is demonstrated in European Application No. 0237274. Cork is an example of a water insoluble, non-oxidizing solid additive. Table II presents penetrometer readings and detonation velocity measurements, both of which demonstrate emulsion stability. The emulsion formulations used in all of the examples of the present invention are set forth in Table I.

TABLE I

Emulsion Formulations Used in The Example (Expressed in weight percent.)

| Ingredient | I | II | III | IV | V |
|---|---|---|---|---|---|
| Ammonium Nitrate[a] | 72.8 | 72.8 | 72.5 | 78.0 | 76.4 |
| Sodium Nitrate[a] | 10.0 | 10.0 | 10.0 | — | — |
| Water | 10.0 | 10.0 | 10.0 | 16.0 | 15.6 |
| Mineral Oil | 1.7 | 3.5 | 3.5 | 3.7 | 7.0 |
| Wax[b] | — | — | — | 1.3 | — |
| Emulsifier[c or d] | 3.0[c] | 1.2[c] | 1.2[d] | 1.0[c] | 1.0[d] |
| Microspheres[e] (glass) | 2.5 | 2.5 | 2.9 | 1.0 | — |

[a]Oxidizer salt dissolved in the water, discontinuous phase.
[b]Mixtures of paraffin and microcrystalline waxes (3:1 by weight).
[c]Sorbitan monooleate
[d]Ethanolamine addition products of polyisobutylene succinic anhydride.
[e]C/15/250 from 3M.

The compositions of Table I were prepared by standard procedures well known in the industry.

The following procedures were used in the experiment summarized in Table II. Laboratory adaptations of the emulsion/cork mixtures of about 1200 grams were made to a constant consistency. These were packaged in a 1-¼ inch by 8 inch cartridge for detonation testing and also in a 4 to 6 ounce plastic container for penetrometer testing. Within about one to three hours, the penetration depth of a standard cone was measured in the sample in the plastic cup. This measurement gives an indication of the sample hardness. The greater the depth, larger the value, the softer the sample and thus the more stable emulsion. These emulsions were all made with an all oil fuel, and thus the stiffer emulsion, smaller value, indicates hardening due to crystallization, and thus emulsion breakdown.

In Table II, comparison of Product A and Product D demonstrates that small differences in cork content does not give a large difference in stability results. Compositions A and D compared to Composition C indicates the improvement in stability possible by increasing the amount of emulsifier in the emulsion. Comparing Example C with Composition B demonstrates that the use of a surfactant to coat the solid improves stability of the blend. In Example B, the sorbitan monooleate coated the cork surface and took up sites which would otherwise attract the emulsifier molecules to the surface.

Samples F and G demonstrate the instability caused by solids which had not been coated.

TABLE II

Comparisons of Various Emulsion/Solid Products

| | A | B | C | D | E | F | G |
|---|---|---|---|---|---|---|---|
| Emulsion[a] | 85.0 | — | — | 85.7 | 83.6 | 95.0 | 94.0 |
| Emulsion[b] | — | 85.0 | 83.7 | — | — | — | — |
| Cork | 15.0 | 14.85 | 16.3 | 14.3 | 16.4 | — | — |
| Sorbitan Monoleate[c] | — | .15 | — | — | — | — | — |
| Sawdust | — | — | — | — | — | 5.0 | — |
| Balsa | — | — | — | — | — | — | 6.0 |
| Density (g/cc) | 1.07 | 1.04 | .96 | 1.01 | 1.13 | 1.15 | 1.18 |
| Penetrometer (mm) | 8.6 | 18.1 | 3.3 | 8.5 | 12.9 | .7 | 0 |
| Detonation Velocity (1¼" × 3" ctg with #8 cap. fps.) | 12,500 | 13,160 | F | 10,416 | 12,500 | F | F |

F = failure
[a]= See Table I
[b]= See Table I
[c]= Surfactant having a basic moiety type used to coat the cork.

A simple screening test is useful to determine whether solids will attract the emulsifier from the emulsion. The screening test is useful for porous and nonporous solids added to water-in-oil or melt-in-fuel emulsions. If the solids will attract the emulsifier, these solids should be coated according to the present invention. The screening test determines whether the solid has either acidic or basic sites that will attract the emulsifier used to form the emulsion and is conducted as follows. Five grams of the solid were mixed into about 100 grams of a nominal 65% by weight solution of emulsifier and mineral oil and left to sit for about 16 hours. Samples of liquid were then analyzed for emulsifier content. The emulsifier used could be either an acid or a base. In the present example, a base was used because it was believed that the solid had acidic surfaces. If the percentage of emulsifier in the sample test is lower than that originally in the mineral oil then the solid contains active acidic sites. If the percentage of emulsifier is the same as originally added to the mineral oil then the solid has no active acidic sites. Results are given in Table III. The results of the screening tests indicate that each of the solids have an affinity for the emulsifier. The results in Table II indicate that all the solids destabilized the emulsions as predicted by the screening test. The amount of migration and thus destabilization of the emulsion is represented by the percentage value given. The greater the percentage value the less migration of the emulsifier out of the mineral oil. The smaller the percentage the greater migration of the emulsifier from the mineral oil to the solid surface. The degree of migration determined by the screen test indicates an approximation of the amount of surfactant needed to sufficiently coat the various solids to eliminate destabilization. While this type of test can give an indication as to amount of surfactant required for neutralization, it does not represent the actual physical and chemical conditions that exist in the emulsion explosive. It therefore cannot be used as the sole tool for determining surfactant quantities. For this latter purpose, there is no substitute for optimization experiments using the emulsion formulation.

TABLE III

| Attraction of Solid Surface for Emulsifier Molecule | |
|---|---|
| | % Emulsifier in Mineral Oil |
| Control | 62.5 |
| Sawdust | 61.7 |
| Balsa | 60.3 |
| Cork (40/80) | 60.7 |
| Cork (80/0) | 59.5 |

EXAMPLE 2

Other important solid additives in water-in-oil or melt-in-fuel emulsions are ammonium nitrate (AN), sodium nitrate (SN), and ammonium nitrate coated with fuel oil (ANFO). Although ANFO is typically ammonium nitrate prills coated with fuel oil so that it is oxygen-balanced, it will generally be referred to in this disclosure as a solid oxidizer salt. Other supplemental fuels can be added to the emulsion such as nonparticulate metals, e.g., aluminum. The oxidizers added to the emulsion may be in various particulate forms, from a relative dense solid to a less dense prill. Generally in the industry, prills of ammonium nitrate and sodium nitrate of various densities are employed rather than dense solid particles. Table IV demonstrates the use of present technology with ammonium nitrate prills. The emulsion formulation utilized is given in Table I. However, in addition, both coated and uncoated ammonium nitrate prills as well as aluminum was added to the emulsion. Samples were packaged in 1.25 inch by 8 inch cartridges and then cycled on a daily basis between 70° F. and 110° F. Eight hours at 110° F. and then 16 hours at 70° F. constituted one cycle. These materials were then tested for detonability at 10° F. with a #8 blasting cap. This test procedure is useful as a method for predicting long term shelf life for these products. As can be see by the table, the results indicate significant differences. By adding a surfactant to coat the solids, the shelf life has been extended at least three-fold over uncoated solids. Contrary to the teachings of U.S. Pat. No. 4,555,278, the use of a higher amount of sorbitan monooleate does not cause emulsion breakdown via a water migration mechanism. Rather, it actually improves resistance to emulsion breakdown. Further, the art does not demonstrate nor distinguish between AN and ANFO. The results achieved are somewhat surprising because of the relative similarities between mineral oil and diesel fuel oil.

TABLE IV

| Cycle Test Results of AN/Emulsion Products | | | |
|---|---|---|---|
| | I | J | K |
| Emulsion (See Table I, Emulsion III) | 85.0 | 85.0 | 85.0 |
| AN[a] | 13.1 | 12.8 | 12.9 |
| Al | 1.9 | 1.9 | 1.7 |
| Mineral Oil[b] | — | .3 | .3 |
| Sorbitan Monooleate (SMO)[c] | — | — | .1 |
| Detonation Velocity (10° F., 1¼" × 8", fps) | | | |
| After 5 Cycles | 13,157 | 12,500 | 13,888 |
| After 10 Cycles | F | Det | 13,157 |
| After 15 Cycles | F | F | 13,888 |

[a]= Solid AN in prill form.
[b]= Mineral oil coating on the AN.
[c]= SMO coated on the solid AN.

EXAMPLE 3

Another set of compositions illustrating the present invention as set forth in Table V. In these tests, 50/50 mixtures of emulsion and various AN prills are utilized. The emulsion used is given in Table I. Experimental data is given in terms of electrical resistance. The numbers recorded are in terms of the negative of the log of the base 10 which makes comparison easier. The electrical resistance ("ER") measures the resistance to the flow of electrons through the blended emulsion sample. The higher number indicates a better emulsion, i.e., a more stable emulsion. An ER value of 10 indicates a good emulsion and an ER value of 5.4 represents a complete emulsion breakdown.

Example L is the control emulsion used to set a standard ER value. Comparison of Examples L and M demonstrates that no emulsion breakdown occurred by the addition of a clay coating which has been used with some samples. Comparison of Samples N and O demonstrates that the amount of solid surface area is important in destabilizing an emulsion. Agricultural grade prills have less surface area exposed to an emulsion and give less breakdown in the system than industrial grade prills. In general, agricultural grade prills are more dense, i.e., about 1.0 g/cc bulk density as compared to industrial prills which have a bulk density of about 0.85 g/cc. The more dense the prill, the less surface area is exposed to the emulsion which thus produces more stability. Comparison of Sample M with Sample N demonstrates the destabilization or breakdown effect of ammonium nitrate on the emulsion.

Comparison of Samples P and Q demonstrates that using prior coating agents such as Petro Ag which were used to prevent caking of ammonium nitrate prills during storage do not solve the emulsion destabilization problem with those particular prills. Typically, other coating agents are used to hold clay on the surface of the prills to prevent caking of the prills during storage. AN prills are hydroscopic and unless coated, in high humidity conditions the prills tend to cake together. These samples demonstrate that it is important to select an appropriate coating agent in order to achieve stability when the prills are incorporated into a water-in-oil emulsion explosive product This is equally true for melt-in-fuel compositions.

Sample R demonstrates a prior art attempt in which the prill was coated with a water impermeable coating, i.e., cellulose acetate butyrate (CAB).

Sample S demonstrates the present invention. Lilamine is a surfactant of the basic moiety type which neutralizes, i.e., ties up the active acid sites of the prill surface. This renders these sites neutralized and thus makes them available to deplete the emulsifier molecules from the surface of the droplets of the discontinuous phase of the emulsion. In this example, a Lilamine coating was used and the example demonstrates that the Lilamine coating is effective to maintain stability of the emulsion. Further, comparison of S with N demonstrates the improvements achieved by selecting an appropriate coating agent.

TABLE V

Comparison of various 50/50 Emulsion/AN Prill Mixtures

| | Product | Electrical Resistance Values | |
|---|---|---|---|
| | | As Made | 1 Week |
| L | Emulsion IV | 9.6 | 9.7 |
| M | Emulsion IV + 1% Clay[a] | 9.9 | 10.0 |
| N | Emulsion IV/Industrial Prills & Clay | 7.5 | 7.4 |
| O | Emulsion IV/Agricultural Prills | 9.0 | 9.3 |
| P | Emulsion IV/Industrial Prills + Clay + PAG[b] | 5.4 | 5.4 |
| Q | Emulsion IV/Agricultural Prills + Clay + PAG | 7.8 | 6.4 |
| R | Emulsion IV/Industrial Prills + Clay + PAG + CAB[c] | 8.7 | 8.6 |
| S | Emulsion IV/Industrial Prills + Lilamine[d] | 8.7 | 8.9 |

[a]= Celatom clay
[b]= PAG = Petro AG, an oxylalkyl sulfonate, about 0.5%
[c]= Cellulose Acetate Butyrate Coating (CAB)
[d]= About 0.5%

EXAMPLE 4

In this example, the use of ANFO utilizing industrial grade prills, Petro Ag and clay without a coating demonstrates that the incorporation of this type of ANFO into certain emulsions results in breakdown. Samples T, V, and W of Table VI were made with Emulsion V of Table I. ANFO was made utilizing industrial grade prills at various mixing temperatures. The prills were coated with clay and Petro Ag. The mixtures were kept at 70° F. for 22 days. The percent of emulsifier in the unmixed emulsion and in the emulsion portions of the mixtures was tested. The results presented in Table VI show a dramatic drop in emulsifier content in the mixed systems. Depletion of the emulsifier accounts for the emulsion breakdown of these products.

TABLE VI

Comparison of Emulsifier Contents of 60/40 Mixtures Made at Various Temperatures

| | Mixture | Process Temperature | % Emulsifier |
|---|---|---|---|
| T | Emulsion V | — | 0.90 |
| V | 60/40 (Emulsion V/ANFO) | 70° F. | 0.71 |
| W | 60/40 (Emulsion V/ANFO) | 130° F. | 0.62 |

EXAMPLE 6

As discussed above, the choice of a surfactant to coat the solid must be compatible with the emulsifier used to produce the emulsion. It is useful to conduct experiments involving the type and amount of surface active agents to assess this compatibility. Table VII exemplifies this test procedure. The experiment was conducted as described for the data reported in Table III. In this case, the emulsifier type and the mineral oil was varied. The nominal 65% mixture by weight of surfactant and mineral oil was made and 50 grams of ground particulate AN was placed in contact with the mixture. This was kept for seven days at 70° F. After seven days, the free mineral oil not adhering to the prill was poured off and analyzed to determine the amount of surfactant present. It can be seen that the amount of emulsifier is lower for the PIBSA but not for the oleic acid.

The AN surface prior to being coated had acidic active sites. The polyisobutylene succinic anhydride ("PIBSA") having a basic moiety was attracted to the AN to a much greater degree than the acidic oleic acid. Also, Lilamine contains a basic moiety and would also be expected to be attracted to the AN surface. These results can be compared to Table V.

TABLE VII

Comparison of "Attracting Power" of AN for Various Surface Active Agents

| Surface Active Agent | Acidic or Basic | % Surfactant in Mineral Oil | |
|---|---|---|---|
| | | Control | In Contact with AN |
| PIBSA[a] | Basic | 63 | 46 |
| Oleic Acid | Acidic | 67 | 69 |

[a]= Ethanolamine addition products of polyisobutylene succinic anhydride.

The processes utilized to determine whether a solid has acid or base active sites is illustrated above. The screening tests described allow those skilled in the art to make that determination and to select the appropriate surfactant and an approximate amount of surfactant needed to neutralize these acidic and basic sites. Neutralization occurs when the emulsion experiences little or no breakdown in the presence of the solid. For example, this is shown in the screening test set forth in Example 4. The basic procedure is: make the emulsion, coat the solid, add the coated solid to the emulsion at the mix temperature of the emulsion, keep the mixture at 70° F. for about 10 to 15 days, analyze the emulsion for percent emulsifier, compare this result to the amount of emulsifier in the emulsion originally. Vary the coating amount until no emulsifier depletion occurs.

As known in the art, and readily determinable by the tests above, an excess of surfactant to coat the solid can actually destabilize the emulsion. As understood in the art, this is caused by the fact that the surfactant used to coat the solid can, if used in excess, actually replace the emulsifier at the droplet surface of the discontinuous phase. If the coating surfactant is a less proficient emulsifier than the one replaced, then the result is a less stable emulsion. The amount of coating surfactant needed also depends upon the surfactant selected. The main surfactant characteristics determining amount of surfactant needed is the acid or base strength of the acidic or basic moiety, the number of such moieties per molecule and the overall weight of the molecule.

We claim:

1. A solid consisting of ammonium nitrate for use with a water-in-oil or melt-in-fuel emulsion to produce a blended explosive, said solid having acidic sites on its surface coated with a surfactant having a basic moiety in sufficient quantity to substantially neutralize the acidic sites on the solid.

2. The solid of claim 1 wherein the surfactant is comprised of a hydrogenated tallow amine or sorbitan monooleate.

3. A solid consisting of cork for use with a water-in-oil or melt-in-fuel emulsion to produce a blended explosive, said solid having acidic sites on its surface coated with a surfactant having a basic moiety in sufficient quantity to substantially neutralize the acidic sites on the solid.

4. The solid of claim 3 wherein the surfactant is comprised of a hydrogenated tallow amine or sorbitan monooleate.

5. A solid consisting of balsa for use with a water-in-oil or melt-in-fuel emulsion to produce a blended explosive, said solid having acidic sites on its surface coated with a surfactant having a basic moiety in sufficient quantity to substantially neutralize the acidic sites on the solid.

6. The solid of claim 5 wherein the surfactant is comprised of a hydrogenated tallow amine or sorbitan monooleate.

7. A solid consisting of microspheres for use with a water-in-oil or melt-in-fuel emulsion to produce a blended explosive, said solid having acidic sites on its surface coated with a surfactant having a basic moiety in sufficient quantity to substantially neutralize the acidic sites on the solid.

8. The solid of claim 7 wherein the surfactant is comprised of a hydrogenated tallow amine or sorbitan monooleate.

9. A solid consisting of microspheres for use with a water-in-oil or melt-in-fuel emulsion to produce a blended explosive, said solid having basic sites on its surface coated with a surfactant having an acidic moiety in sufficient quantity to substantially neutralize the basic sites on the solid.

10. The solid of claim 9 wherein the surfactant is comprised of oleic acid.

11. A solid consisting of rubber for use with a water-in-oil or melt-in-fuel emulsion to produce a blended explosive, said solid having acidic sites on its surface coated with a surfactant having a basic moiety in sufficient quantity to substantially neutralize the acidic sites on the solid.

12. The solid of claim 11 wherein the surfactant is comprised of a hydrogenated tallow amine or sorbitan monooleate.

13. A solid consisting of rubber for use with a water-in-oil or melt-in-fuel emulsion to produce a blended explosive, said solid having basic sites on its surface coated with a surfactant having an acidic moiety in sufficient quantity to substantially neutralize the basic sites on the solid.

14. The solid of claim 13 wherein the surfactant is comprised of oleic acid.

15. A solid consisting of sodium nitrate for use with a water-in-oil or melt-in-fuel emulsion to produce a blended explosive, said solid having acidic sites on its surface coated with a surfactant having a basic moiety in sufficient quantity to substantially neutralize the acidic sites on the solid.

16. The solid of claim 15 wherein the surfactant is comprised of a hydrogenated tallow amine and an organic acid or sorbitan monooleate.

17. A solid incorporated into a melt-in-fuel emulsion, said solid having acidic sites on its surface coated with a surfactant having a basic moiety in sufficient quantity to substantially neutralize the acidic sites on said solid.

18. The solid of claim 17 wherein the surfactant is comprised of a hydrogenated tallow amine, an organic acid, and mineral oil or sorbitan monooleate.

19. The solid of claim 17 wherein the solid consists of sodium nitrate or ammonium nitrate.

20. The solid of claim 17 wherein the solid consists of glass or resin microspheres.

21. The solid of claim 17 wherein the solid consists of rubber.

22. The solid of claim 17 wherein the solid consists of balsa.

23. The solid of claim 17 wherein the solid consists of cork.

* * * * *

UNITED STATES PATENT AND TRADEMARK OFFICE

CERTIFICATE OF CORRECTION

PATENT NO. : 5,123,981

DATED : June 23, 1992

INVENTOR(S) : Mullay et al.

It is certified that error appears in the above-identified patent and that said Letters Patent is hereby corrected as shown below:

Column 1, Line 49, delete "were".

Column 1, Line 50, after "emulsions" insert --,--.

Column 1, Line 60, after "Powermax" insert --®--.

Column 1, Line 66, after "emulsions" insert --,--.

Column 2, Line 2, delete "that they".

Column 2, Line 11, delete "will then produce" and insert therefore --produces--.

Column 2, Line 12, delete "cave in." and insert therefore --cave-in.--.

Column 2, Line 29, delete "i.e." and insert therefore --i.e.--.

Column 2, Line 29, delete "that".

Column 2, Line 49, delete "For example, see U.S. Pat. No. 4,555,271." and insert therefore --(See U.S. Patent No. 4,555,271.)--.

Column 3, Line 48, delete "as" and insert therefore --As--.

Column 3, Line 66, delete "i.e." and insert therefore --i.e.--.

Column 4, Line 1, delete "i.e." and insert therefore --i.e.--.

UNITED STATES PATENT AND TRADEMARK OFFICE

CERTIFICATE OF CORRECTION

PATENT NO. : 5,123,981

DATED : June 23, 1992

INVENTOR(S) : Mullay et al.

It is certified that error appears in the above-identified patent and that said Letters Patent is hereby corrected as shown below:

Column 4, Line 2, delete "[$PNH_2$]" and insert therefore --[$RNH_2$]--.

Column 4, Line 16, delete "i.e." and insert therefore --i.e.--.

Column 4, Lines 18-19, after "Lilamine" insert --®--.

Column 5, Line 21, after "moiety" insert --,--.

Column 6, Lines 20-21, delete "Compositions A and D compared to Composition C" and insert therefore --Products A and D compared to Product C--.

Column 6, Line 23, delete "Example" and insert therefore --Product--.

Column 6, Line 24, delete "Composition" and insert therefore --Product--.

Column 6, Line 26, delete "Example" and insert therefore --Product--.

Column 6, Line 29, delete "Samples" and insert therefore --Products--.

Column 6, Line 30, delete "had" and insert therefore --have--.

Column 6, Line 62, delete "were" and insert therefore --are--.

UNITED STATES PATENT AND TRADEMARK OFFICE

CERTIFICATE OF CORRECTION

PATENT NO. :5,123,981

DATED :June 23, 1992

INVENTOR(S) :Mullay et al.

It is certified that error appears in the above-identified patent and that said Letters Patent is hereby corrected as shown below:

Column 6, Line 65, delete "were" and insert therefore --are--.

Column 6, Line 66, delete "could" and insert therefore --can--.

Column 7, Line 11, after "given", insert --in Table III--.

Column 7, Line 14, after "percentage" insert --,--.

Column 7, Line 19, after "to" insert --the--.

Column 7, Line 46, delete "e.g." and insert therefore --e.g.--.

Column 8, Line 36, delete "i.e." and insert therefore --i.e.--.

Column 8, Line 40, delete "Example" and insert therefore --Product--.

Column 8, Line 41, delete "Examples" and insert therefore --Products--.

Column 8, Line 44, delete "Samples" and insert therefore --Products--.

Column 8, Line 50, delete "i.e." and insert therefore --i.e.--.

UNITED STATES PATENT AND TRADEMARK OFFICE

CERTIFICATE OF CORRECTION

PATENT NO. : 5,123,981

DATED : June 23, 1992

INVENTOR(S) : Mullay et al.

It is certified that error appears in the above-identified patent and that said Letters Patent is hereby corrected as shown below:

Column 8, Line 54, delete "Sample M with Sample N" and insert therefore --Product M with Product N--.

Column 8, Line 57, delete "Samples" and insert therefore --Products--.

Column 8, Line 58, after "Petro Ag" insert --®--.

Column 8, Line 66, delete "samples" and insert therefore --products--.

Column 9, Line 3, delete "Sample" and insert therefore --Product--.

Column 9, Line 5, delete "i.e." and insert therefore --i.e.--.

Column 9, Line 6, delete "Sample" and insert therefore --Product--.

Column 9, Line 8, delete "i.e." and insert therefore --i.e.--.

Column 9, Line 10, delete "available" and insert therefore --unavailable--.

Column 9, Line 12, delete "example" and insert therefore --product--.

Column 9, Line 12, after "Lilamine" insert --®--.

UNITED STATES PATENT AND TRADEMARK OFFICE

CERTIFICATE OF CORRECTION

PATENT NO. : 5,123,981

DATED : June 23, 1992

INVENTOR(S) : Mullay et al.

It is certified that error appears in the above-identified patent and that said Letters Patent is hereby corrected as shown below:

Column 9, Line 13, delete "example" and insert therefore --product--.

Column 9, Line 14, after "Lilamine" insert --®--.

Column 9, Line 15, delete "comparison of S and N" and insert therefore --comparison of Product S with Product N--.

Column 9, Line 19, delete "various" and insert therefore --Various--.

Column 9, Line 35, delete "Petro AG" and insert therefore --Petro Ag®--.

Column 9, Line 42, after "Petro Ag" insert --®--.

Column 9, Line 44, delete "Samples" and insert therefore --Products--.

Column 9, Line 48, after "Petro Ag" insert --®--.

Column 10, Line 18, after "Lilamine" insert --®--.

Signed and Sealed this

Twelfth Day of October, 1993

Bruce Lehman

*Attest:*

BRUCE LEHMAN

*Attesting Officer*

*Commissioner of Patents and Trademarks*